US011295588B2

(12) United States Patent
Escofet Via

(10) Patent No.: US 11,295,588 B2
(45) Date of Patent: Apr. 5, 2022

(54) BEAM SMOKE DETECTOR SYSTEM

(71) Applicant: Carrier Corporation, Palm Beach Gardens, FL (US)

(72) Inventor: Jordi Escofet Via, Barcelona (ES)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/113,302

(22) Filed: Dec. 7, 2020

(65) Prior Publication Data

US 2021/0304573 A1 Sep. 30, 2021

(30) Foreign Application Priority Data

Mar. 30, 2020 (EP) ..... 20382248

(51) Int. Cl.
*G08B 17/10* (2006.01)
*G08B 13/189* (2006.01)

(52) U.S. Cl.
CPC ..... *G08B 13/1895* (2013.01)

(58) Field of Classification Search
CPC ..... G08B 13/1895
USPC ..... 340/630
See application file for complete search history.

(56) References Cited

U.S. PATENT DOCUMENTS 4,233,882 A * 11/1980 Eichweber ..... F41A 19/58 102/480
5,280,272 A * 1/1994 Nagashima ..... G08B 17/107 250/574
5,387,211 A * 2/1995 Saadatmanesh ..... G02B 27/145 606/10
5,751,436 A * 5/1998 Kwon ..... H04N 1/10 219/121.68
5,767,650 A * 6/1998 Dehli ..... G09F 11/00 318/446
6,011,478 A * 1/2000 Suzuki ..... G08B 17/107 250/574
8,508,376 B2 * 8/2013 Knox ..... G08B 17/103 340/628
8,681,012 B2 * 3/2014 Murray ..... G08B 17/107 340/629
2002/0008870 A1 * 1/2002 Beliveau ..... G01C 15/002 356/152.1

(Continued)

FOREIGN PATENT DOCUMENTS

JP H04148493 A 5/1992
JP H05340873 A 12/1993

(Continued)

OTHER PUBLICATIONS

Partial European Search Report Issued for European Application No. 20382248.1; dated Sep. 18, 2020 (pp. 1-14).

(Continued)

*Primary Examiner* — Kerri L McNally
*Assistant Examiner* — Thang D Tran
(74) *Attorney, Agent, or Firm* — Cantor Colburn LLP

(57) ABSTRACT

A smoke detector system 20 is disclosed, including a beam detector unit 10 having a moveable portion 14 comprising at least one light transmitter 16, a base portion for fixing to a surface, and a motor configured to rotate the moveable portion 14 relative to the base portion. The system also has at least one receiver for detecting light transmitted by the transmitter.

13 Claims, 3 Drawing Sheets

(56) References Cited

U.S. PATENT DOCUMENTS

2002/0033940 A1* 3/2002 Hedges ..... G01C 15/002 356/141.4
2004/0155786 A1 8/2004 Guttinger et al.
2008/0062255 A1* 3/2008 Gal ..... G08B 13/19628 348/37
2008/0316039 A1* 12/2008 White ..... G08B 29/20 340/630
2010/0226617 A1* 9/2010 Piccionelli ..... A47G 33/08 345/2.1
2012/0050030 A1* 3/2012 Murphy ..... G08B 17/113 340/514
2013/0038856 A1* 2/2013 Williams ..... G01C 15/002 356/3.12
2013/0140446 A1* 6/2013 Benner, Jr. ..... G01D 5/34 250/231.16
2014/0009747 A1* 1/2014 Suzuki ..... G01S 7/4817 356/4.01
2015/0053016 A1* 2/2015 Sleator ..... G01H 9/00 73/655
2015/0371514 A1* 12/2015 Bonisch ..... G08B 17/103 340/630
2016/0313636 A1* 10/2016 Chien ..... F21S 9/022
2017/0034389 A1* 2/2017 Park ..... H04N 1/00519
2017/0200358 A1* 7/2017 Fang ..... G01S 7/4817
2017/0248699 A1* 8/2017 Fang ..... G01S 7/51
2019/0012885 A1* 1/2019 Kashar ..... G06F 1/163
2019/0079281 A1* 3/2019 Maruyama ..... G01S 17/42
2019/0120938 A1* 4/2019 Shim ..... G02B 13/0005
2020/0217936 A1* 7/2020 Galloway ..... G01M 11/30

FOREIGN PATENT DOCUMENTS

WO 2009062256 A1 5/2009
WO 2009149498 A1 12/2009

OTHER PUBLICATIONS

European Search Report for Application No. 20382248.1; dated Dec. 17, 2020; 13 Pages.

* cited by examiner

BEAM SMOKE DETECTOR SYSTEM

CROSS-REFERENCE TO RELATED APPLICATIONS

This application claims priority to European Application No. 20382248.1, filed Mar. 30, 2020, the contents of which are incorporated by reference herein in their entirety.

FIELD

The present disclosure relates to smoke detector systems including beam detector units, and methods of operating such smoke detector systems.

BACKGROUND

Current fire (smoke) detection systems may include beam detectors for smoke detection, e.g. within large areas. Beam detector systems project a beam of light, such as a laser, to a light detector and determine the presence of smoke in the intervening region from the intensity of the light that is detected at the detector. Such systems may be used to monitor for smoke across large areas. They may be used to detect fires in buildings where the use of point smoke detectors would be uneconomical or restricted, e.g. as point detectors can only detect smoke that contacts them and so many point detectors may be required to effectively monitor a large area. Also, point detectors are typically located on the ceiling of a building, which may be ineffective for monitoring for smoke due to the height or geometry of the ceiling.

As described above, beam detector systems may include a transmitter for emitting a beam of light and a receiver spaced apart from the transmitter, wherein the receiver detects light emitted by the transmitter. Alternatively, beam detector systems may include a transmitter and a receiver located proximate to one another, and a reflector spaced apart from the transmitter and receiver. In these arrangements, the receiver detects light originating from the transmitter, which has been reflected by the reflector.

The beam detector systems are designed to detect light from the transmitter and determine when the intensity of this detected light changes, and the rate of such a change. A sudden change of light intensity may be indicative of an object other than smoke blocking the beam. A slow increase or decrease in the detected light intensity may be indicative of ambient lighting conditions, such as due to the time of day or weather, changing. A predetermined range of rates of change of the light intensity is indicative that smoke is gradually blocking the passage of the light to the receiver from the transmitter (optionally via a reflector). The beam detector system may trigger an alarm when it determines that the rate of change of light intensity is within the predetermined range and so is indicative of the presence of smoke, whereas the system does not trigger the alarm when the rate of change is outside of the predetermined range.

SUMMARY

The present disclosure provides a smoke detector system comprising a beam detector unit having a moveable portion comprising at least one light transmitter, a base portion for fixing to a surface, and a motor configured to rotate the moveable portion relative to the base portion, the smoke detector system also comprising at least one receiver for detecting light transmitted by the transmitter.

The at least one transmitter may be configured to generate and transmit any suitable wavelength of light, such as infrared, visible or ultraviolet light. For example, the transmitter may be an LED.

The transmitter may transmit a laser beam or non-coherent light.

The at least one receiver may be any receiver suitable for detecting the intensity of the light transmitted by the at least one transmitter.

In an embodiment, the beam detector unit may comprise the at least one receiver.

The at least one receiver may be located on the moveable portion of the beam detector unit.

The system may comprise a plurality of reflectors for reflecting the light transmitted by the at least one transmitter to the at least one receiver.

The system may comprise more reflectors than transmitters.

Each of the plurality of reflectors may be spaced from the beam detector unit, and from one another.

The reflectors may be arranged such that as the motor rotates the movable portion relative to the base portion, each transmitter sequentially aligns with the plurality of reflectors, so that the light transmitted by the transmitter reflects from the reflector and is subsequently detected by one of the receivers.

In another embodiment, the at least one receiver is a plurality of receivers that are spaced from and separate to the beam detector unit.

The smoke detector system may be configured such that, at particular rotational positions of the moveable portion, any given one of the transmitters is aligned with the receivers, such that light transmitted from the transmitter is detected by the receivers.

In any embodiment, the motor may be configured to rotate the moveable portion at a continuous speed.

The motor may be configured to vary the speed of the rotation of the moveable portion so that it moves at a slower speed or temporarily pauses when one of the at least one transmitter is aligned with one of the at least one receiver or reflector.

A processor may be provided that is configured to control the movement of the moveable portion by controlling the motor, via electrical circuitry. For example, the processor may slow or pause the movement of the moveable portion for a predetermined length of time when a transmitter aligns with a receiver.

The system may be configured such that the motor rotates the moveable portion repeatedly through 360 degrees, e.g. in one circumferential direction. Alternatively, the movable portion may be rotated back and forth through an angle of less than 360 degrees. The system may be configured to tilt the axis of rotation of the movable member as it rotates.

The system may comprise a processor configured to monitor the intensity of light received by the at least one receiver and to determine whether a change of intensity, or rate of change of intensity, of the received light falls within a first predetermined range that is indicative of the detected light having passed through smoke.

The processor may be configured to monitor how the intensity of the light detected by the at least one receiver, at rotational positions at which the at least one transmitter is aligned with the at least one receiver, changes with time. The processor may compare the intensity of light detected when the at least one transmitter is aligned with one of the receivers to the intensity of light detected when the transmitter was previously aligned with the same one, or another one, of the receivers. The processor may then determine whether the change of intensity, or rate of change of intensity, of the received light falls within the predetermined range.

The processor may be configured to determine whether a change of intensity, or rate of change of intensity, of the received light falls within a second predetermined range that is indicative of the detected light having potentially passed through smoke, and if the received light falls within the second predetermined range, to slow or pause the movement of the moveable portion when the transmitter is aligned with a receiver.

The second predetermined range is different from the first predetermined range. The first predetermined range may indicate a relatively rapid change of intensity, whereas the second predetermined range may indicate a slower change of intensity.

The system may comprise an alarm, wherein the system is configured to trigger or not trigger the alarm based on the light detected at the at least one receiver.

The system may comprise a processor and electronic circuitry configured such that, in an auto-calibration mode, the system records both the rotational position of the movable member and the intensity of light detected by the at least one receiver, determines the rotational positions of the moveable member at which the intensity of light peaks, and designates these rotational positions as being the positions at which the at least one transmitter is aligned with the at least one receiver (i.e. those rotational positions determined during the auto-calibration mode).

The system may be configured to control the motor, in a smoke detection mode, to rotate the movable portion such that it slows down or pauses at said rotational positions when the at least one transmitter is aligned with the at least one receiver.

The system may include a plurality of the above described beam detector units 10, so as to provide coverage to a larger area, and/or to provide more frequent coverage to an area. The system may include 2, 3, 4, or more than 4 beam detector units, and each beam detector unit may cover different ranges, and/or include a different number of reflectors or receivers. The angles of rotation and different numbers of reflectors or receivers should encompass full 360 degree coverage of the area to be protected. For example, the system may include two beam detector units, and the moveable portion of each may be rotated back and forth through opposing 180 degree angles, so as to cover the entire 360 degrees. The plurality of beam detector units may be intercommunicated by a communication interface. For example, each of the plurality of beam detector units may be connected to the same alarm via the communication interface. The alarm may be configured to trigger or not trigger based on the light received at the at least one receivers of at least one of the plurality of beam detector units.

Additionally or alternatively, when a processor has detected that a change of intensity, or rate of change of intensity, of received light of a receiver of a beam unit is indicative of the detected light having passed through smoke or indicative of the detected light having potentially passed through smoke, the communication interface may cause another beam detector unit to move to, or stop or pause at a location proximate to the location in which the initial beam detector unit has detected that the light may have passed through, or may potentially have passed through, smoke.

The present disclosure also provides a method of operating a smoke detector system, comprising providing a smoke detector system as described above, transmitting light from the at least one light transmitter, rotating the movable portion of the beam detector unit relative to the base portion of the beam detector unit using the motor, and detecting an intensity of light transmitted by the at least one transmitter using the at least one receiver.

BRIEF DESCRIPTION OF DRAWINGS

Various embodiments will now be described, by way of example only, and with reference to the accompanying drawings in which.

DETAILED DESCRIPTION

Figure 1:
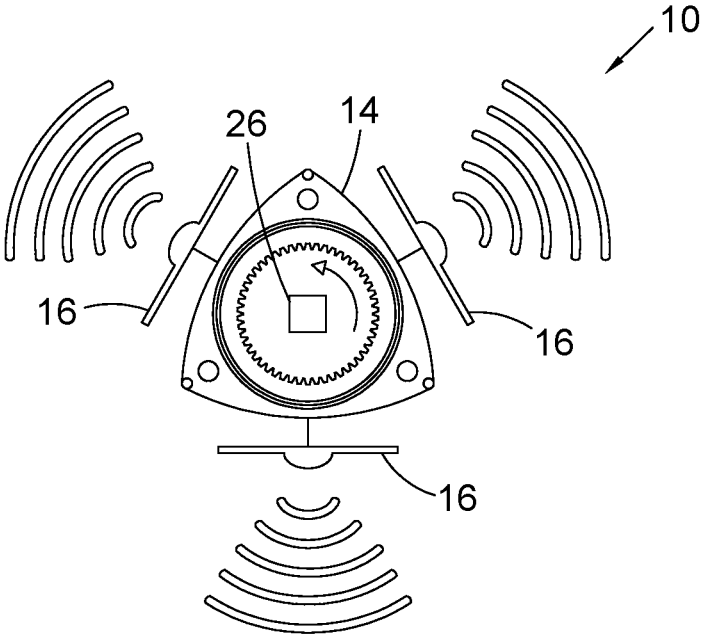
FIG. 1 shows a schematic of a beam detector unit in accordance with an embodiment of the present disclosure.

FIG. 1 shows a schematic of an embodiment of a beam detector unit 10 for detecting smoke. The beam detector unit 10 comprises a base portion (not shown) for mounting to a surface, such as a wall or ceiling, and a moveable portion 14 that moves relative to the base portion. In the embodiment shown in FIG. 1, the moveable portion 14 comprises three light transmitters 16 spaced around the circumference of the movable portion 14. However, any suitable number of transmitters 16 may be used, such as one, two, three, four, five, or more than five transmitters. In an embodiment, one transmitter is used.

Each transmitter 16 generates and transmits light for use in smoke detection. Each transmitter 16 may generate any suitable wavelength(s) of light, such as infrared, visible, or ultraviolet light. Different transmitters 16 may transmit light of the same wavelength(s) or of different wavelength(s). The transmitter may transmit a laser beam or incoherent light.

As described above, the moveable portion 14 is rotatable relative to the base portion. The beam detector unit 10 comprises a motor (not shown) configured to rotate the moveable portion 14 relative to the base portion (i.e. in a circumferential direction). The moveable portion 14 and/or the base portion may comprise at least one light receiver (not shown) for detecting light that has been transmitted away from the unit 10 by the transmitters 16 and reflected back. The movable portion 14 and/or base portion may comprise any suitable number of light receivers, such as an individual receiver for each transmitter 16.

Figure 2:
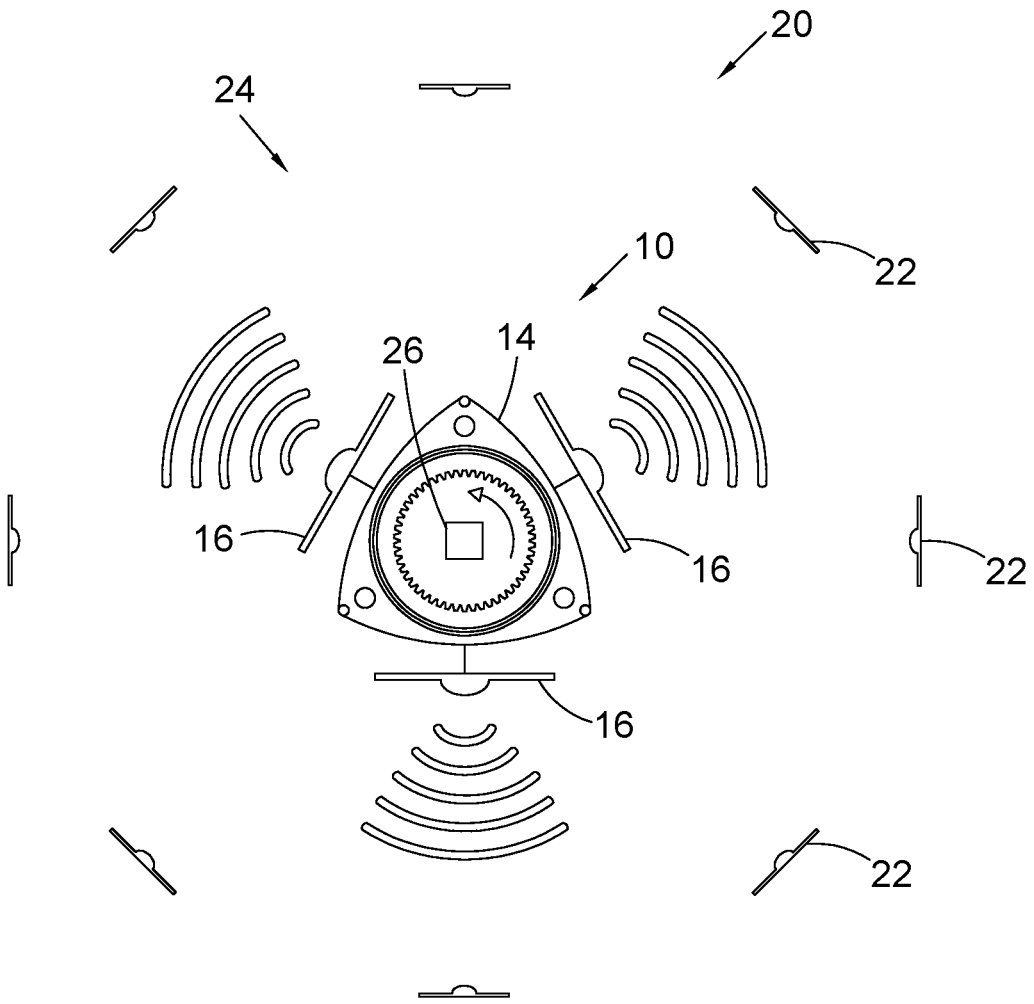
FIG. 2 shows a schematic of an embodiment of a fire/smoke detector system including the beam detector unit of FIG. 1.

FIG. 2 shows a schematic of an embodiment of a smoke detector system 20 in accordance with the present disclosure. The smoke detector system 20 includes the beam detector unit 10 of FIG. 1 and also a plurality of reflectors 22. The plurality of reflectors 22 are dispersed throughout a detection region 24 surrounding the beam detector unit 10. The plurality of reflectors 22 are circumferentially spaced about the beam detector unit 10 such that as the movable member 14 of the unit 10 rotates, the light emitted from any given one of the light transmitters 16 will sequentially be directed onto different ones of the reflectors and reflected back to one or more of the light receivers on the unit 10. The number of reflectors 22 may exceed the number of transmitters 16 and/or receivers and therefore, by rotating the movable portion 14 of the unit 10, the beam detector system is able to monitor a relatively large area for smoke.

In the embodiment of FIG. 2, the plurality of reflectors 22 are regularly spaced in a circumferential direction around the unit 10, and are equidistant from the beam detector unit 10. However, the plurality of reflectors 22 may be unevenly circumferentially spaced and/or at differing distances from the beam detector unit 10. In use, the location of each of the plurality of reflectors 22 is tailored to the geometry of the space to be monitored for smoke.

In the embodiment of FIG. 2, the plurality of reflectors 22 are all located in the same plane. The system is calibrated (as will be discussed in more detail below) such that, as the moveable portion 14 of the beam detector unit 10 rotates, each of the transmitters 16 will sequentially align with sequentially arranged reflectors 22. The transmitter 16 being aligned with a reflector 22 refers to the transmitter, reflector and receiver being relatively positioned such that a light beam transmitted from the transmitter 16 reflects from the reflector 22 and is received by the receiver. The transmitter 16 sequentially aligning with each reflector as the movable portion 14 rotates refers to the transmitter 16 being aligned with a reflector 22, then subsequently moving to be aligned with another reflector 22, then subsequently moving to be aligned with a further reflector 22, and repeating this until the transmitter 16 has aligned with at least some or all of the reflectors 22.

In alternative embodiments, the plurality of reflectors 22 may not be located in the same plane. The light beam transmitted by the transmitter 16 may be fan shaped such as to fan out in a dimension orthogonal to the plane in which the movable member 14 rotates, and thus the light reaches reflectors 22 which are displaced from that plane. Such displaced reflectors 22 are positioned such that the light beam from at least one of the transmitters 16 is reflected therefrom and received by the one or more receiver on unit 10.

The motor may be configured to move the moveable portion 14 at a continuous speed. Alternatively, the motor may be configured to rotate the moveable portion 14 at a non-continuous speed. In such embodiments, the motor 14 may be configured to rotate the moveable portion at a substantially continuous rate when the transmitter 16 is not aligned with a reflector 22. When the transmitter 16 is aligned or substantially aligned with a reflector 22, the motor may be configured to rotate the movable portion 14 at another, slower continuous rate, or may be configured to pause or stop moving for a predetermined period of time. The smoke detector system may include one or more processor 26 and electronic circuitry, which controls the movement of the moveable portion 14 by controlling the motor.

The one or more processor 26 may be configured to control the unit 10 to perform an auto-calibration mode for calibrating the system such that it knows the rotational positions of the moveable member 14 at which the transmitters 16 are aligned with the reflectors 22. In the auto-calibration mode, e.g. in test circumstances (i.e. wherein there is known to be no smoke), the motor may rotate the movable portion 14 whilst the processor records both the rotational position of the movable member and the intensity of light received and detected by the one or more receiver. The processor may then determine when the peaks in the intensity of the light received and detected by the one or more receiver occur and designate the rotational positions of the movable portion 14 when these peaks occur as the positions when the transmitters 16 are aligned with the reflectors 22.

Alternatively, the processor may be manually calibrated to determine when the transmitter is aligned with each reflector, such as by a user inputting the locations of the reflectors.

Once the system has been calibrated so as to know the positions of the reflectors 22, (either in the auto-calibration mode or manually) the system may enter a smoke detection mode. In the smoke detection mode, the processor 26 may control the motor to move the movable portion 14 such that the transmitter 16 is sequentially aligned with each reflector 22. As described above, the processor 26 may control the motor such that the movable portion 14 slows down or pauses when the one or more transmitter 16 is aligned with a reflector 22.

In a smoke detection mode, the movable portion 14 of the smoke detector system 20 may move so as to align the transmitter 16 with each reflector 22 in each rotation of the movable portion 14, and may detect smoke (i.e. that is indicative of a fire) from variations in the intensity of light received by the one or more receiver in the same manner as in previous beam smoke detector systems, e.g. by detecting that a predetermined change and/or rate of change in the intensity of light detected has occurred, whilst the transmitter is aligned with any reflector. The one or more processor 26 may record an initial value of the intensity of light received by any given receiver when the transmitter is aligned with a reflector and that receiver, and may then record one or more further values of the intensity of light received by that receiver (or another receiver) after the movable member 14 has been rotated one or more respective times to the position at which the transmitter is aligned with the reflector and that receiver (or said another receiver). The processor may then compare these recorded intensities to determine any changes in the intensity of light, and determine whether a change is indicative of the presence of smoke, e.g. based on the rate of change of intensity of light with time being within a predetermined range that has been determined to be indicative of the presence of smoke.

The processor may be configured to detect when an intensity change (or rate of intensity change) is indicative of the presence of smoke, and may then send a signal to a suitable alarm device (e.g. a speaker, bell, display or mobile device such as a phone or PDA) so that the alarm device signals an alarm, which may be in the form or an audible alarm or a visible message or light. The alarm device may be hard-wired to the smoke detection system or may be in wireless communication therewith.

The processor 26 may additionally be configured to detect when an intensity change (or rate of intensity change) may potentially be indicative of the presence of smoke, but does not meet a threshold for determining that the intensity change is indicative of the presence of smoke. For example, when the detected rate of change of intensity of light is determined to be within a first predetermined range the processor determines that smoke has been detected (and triggers an alarm), whereas when the detected rate of change of intensity of light is determined to be within a second different predetermined range the processor may determine that smoke is potentially present (and not trigger the alarm). The second different predetermined range may be broader than but not include the first predetermined range. Upon determination that smoke is potentially present, the processor 26 may control the movement of the movable portion 14 to slow or pause for longer such that the transmitter 16 remains aligned with the reflector 22 for a greater period of time than the period of time the transmitter 16 is usually aligned with the reflector 22 in each rotation. This enables the system to monitor for changes in the intensity of light over a greater period of time, in case smoke is building up. This feature potentially enables the presence of smoke to be detected earlier than waiting for the transmitter 16 to move to the point that it is again aligned with a receiver. If, after slowing or pausing for longer, smoke is determined to be present, the processor 26 may trigger an alarm as described above. However, if the intensity of light does not further change to an extent that it is indicative of the presence of smoke then the processor 26 will control the motor to move the movable portion 14 to sequentially align the transmitter with sequential reflectors, i.e. revert to the usual rotation. The processor 26 may also trigger an alert to be sent to a device so as to inform a user that the potential presence of smoke has been detected.

As described above, the processor 26 may trigger an alarm when the presence of smoke is detected. The processor 26 may require the presence of smoke to be detected when the transmitter is aligned with only a single reflector 22 before triggering the alarm, or alternatively the processor 26 may require the presence of smoke to be detected when the transmitter is aligned with multiple reflectors 22 before triggering the alarm so as to avoid false triggering.

Whilst in the auto-calibration mode and/or the smoke detection mode, the moveable portion 14 may be configured to perform a full rotation relative to the base portion (i.e. 360 degrees), and optionally continue rotating for multiple rotations in one circumferential direction. Alternatively, the moveable portion 14 may rotate back and forth along only a portion of a full rotation, such as rotating back and forth along an angular range of 180 degrees. In these embodiments, the moveable portion moves in one circumferential direction over a certain degree of rotation, then returns in the opposite circumferential direction and repeats this process. In the smoke detection mode the system may sequentially align the transmitter 16 with each reflector 22 repeatedly in a forward direction then a backward direction (i.e. reversing the sequence of alignments).

The movable portion 14 may rotate continuously in one direction, and may perform a full rotation (i.e. rotate through 360°) at any suitable rate. The time taken to perform a full rotation may vary based on how many reflectors 22 the system is required to move through (e.g. if the system pauses when the transmitter 16 is aligned with each reflector 22). The moveable portion 14 may perform each full rotation in less than 60 seconds, less than 30 seconds, less than 20 seconds, or less than 10 seconds.

The moveable portion 14 may include a plurality of transmitters 16, each transmitter 16 having a corresponding receiver. Each transmitter 16 may align with each and every reflector 22 during each rotation. Alternatively, each transmitter 16 may align with only some of the reflectors 22 during each rotation, but such that every reflector 22 becomes aligned with at least one of the plurality of transmitters 16 during each rotation.

The unit 10 may be configured to tilt the axis of rotation of the moveable portion 14 as the movable portion 14 rotates in order to align the transmitter 16 with reflectors 22 that are not all located in the same plane. The tilt angle may oscillate back and forth as the movable member 14 rotates. Accordingly, in the calibration modes described above, the axis of rotation of the moveable portion 14 may be tilted back and forth during rotation of the movable member 14.

Figure 3:
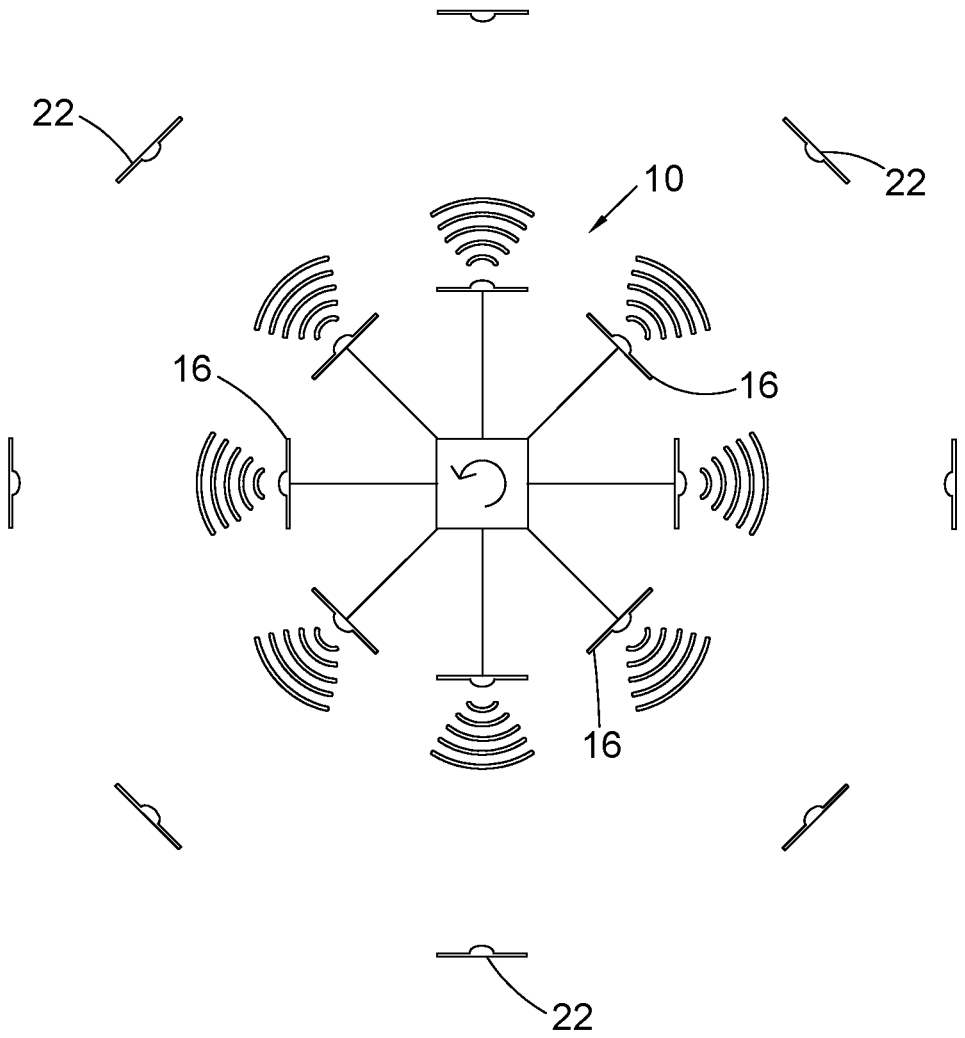
FIG. 3 shows a schematic of another embodiment of a fire/smoke detector system including a beam detector unit.

FIG. 3 shows a schematic of a smoke detector system including a beam detector unit 10 having eight transmitters, although it will be understood that any number of transmitters 16 may be used, as discussed above. Each transmitter 16 may be have a corresponding receiver, or may be a transmitter-receiver, i.e. may include both a transmitter and a receiver. The smoke detector system may otherwise comprise the features of the smoke detector system of FIG. 2. The beam detector unit 10 may rotate in a single direction (i.e. through 360 degrees). Alternatively, the beam detector unit 10 may move back and forth through an angle such that at least one transmitter 16 aligns with each reflector 22 during the movement, i.e. such that, between the transmitters 16, 360 degree coverage is obtained. For example, in FIG. 3, the beam detector unit 10 (having eight equally spaced transmitters 16) may move back and forth through an angle of about 45 degrees. This angle can be different, depending on the number of transmitters 16 and/or reflectors 22.

The system may include a plurality of beam detector units 10, so as to provide coverage to a larger area, and/or to provide more frequent coverage to an area. The system may include 2, 3, 4, or more than 4 beam detector units 10, and each beam detector unit 10 may cover different ranges, and/or include a different number of reflectors or receivers. The angles of rotation and different numbers of reflectors 22 or receivers should encompass full 360 degree coverage of the area to be protected. For example, the system may include two beam detector units, and the moveable portion of each may be rotated back and forth through opposing 180 degree angles, so as to cover the entire 360 degrees. The plurality of beam detector units 10 may be inter-communicated by a communication interface. For example, each of the plurality of beam detector units may be connected to the same alarm via the communication interface. The alarm may be configured to trigger or not trigger based on the light received at the at least one receivers of at least one of the plurality of beam detector units. For example, the processor 26 may require the presence of smoke to be detected when a transmitter 16 is aligned with multiple reflectors 22 before triggering the alarm so as to avoid false triggering, wherein a transmitter 14 being aligned with multiple reflectors 22 may include the same transmitter 16 being aligned with multiple reflectors 22, and a transmitter 16 of each of multiple beam units 10 being aligned with a reflector 22 associated therewith.

Additionally or alternatively, in embodiments wherein a processor 26 is configured to monitor the intensity of light received by the at least one receiver of a beam detector unit and to determine whether a change of intensity, or rate of change of intensity, of the received light falls within a first predetermined range that is indicative of the detected light having passed through smoke and, optionally, to determine whether a change of intensity, or rate of change of intensity, of the received light falls within a second predetermined range that is indicative of the detected light having potentially passed through smoke of the received light falls within the second predetermined range, the communication interface may cause another beam detector unit to move to, or stop or pause at a location proximate to the location in which the initial beam detector unit has detected that the light may have passed through, or may potentially have passed through, smoke.

Although the present disclosure has been described with reference to various embodiments, it will be understood by those skilled in the art that various changes in form and detail may be made without departing from the scope of the invention as set forth in the accompanying claims.

Although embodiments have been described in which reflectors (e.g. mirrors) are specifically provided for reflecting light from the transmitters 16 back to receivers on the unit 10, it is alternatively contemplated that such reflectors 22 may not be provided but that the light may be reflected instead by walls or objects in the environment in which the unit 10 is located.

Alternatively, the beam detector system may comprise a plurality of receivers that are spaced from the unit 10 rather than being provided on the unit 10. In these arrangements, the alignment of the transmitter 16 with a receiver refers to the transmitter 16 and the receiver being located such that a beam transmitter from the transmitter 16 is received (directly) by the receiver. It will be understood that such an arrangement can include any of the above described features, except with the direct transmission of the beam from the transmitter 16 to the receiver, in place of the beam being reflected by a reflector 22 prior to detection by the receiver.

What is claimed is:

1. A smoke detector system comprising:

a beam detector unit having a moveable portion comprising at least one light transmitter, a base portion for fixing to a surface, and a motor configured to rotate the moveable portion relative to the base portion; and at least one receiver for detecting light transmitted by the transmitter;

wherein the motor is configured to vary the speed of the rotation of the moveable portion so that it moves at a slower speed or temporarily pauses when one of the at least one transmitter is aligned with one of the at least one receiver.

2. The system of claim 1, wherein the beam detector unit comprises the at least one receiver.

3. The system of claim 2, wherein the at least one receiver is located on the moveable portion of the beam detector unit.

4. The system of claim 1, wherein the system comprises more reflectors than transmitters.

5. The system of claim 1, wherein each of the plurality of reflectors is spaced from the beam detector unit, and from one another.

6. The system of claim 1, wherein said at least one receiver is a plurality of receivers that are spaced from and separate to the beam detector unit.

7. The system of claim 1, wherein the motor is configured to rotate the moveable portion at a continuous speed.

8. The system of claim 1, comprising a processor configured to monitor the intensity of light received by the at least one receiver and to determine whether a change of intensity, or rate of change of intensity, of the received light falls within a first predetermined range that is indicative of the detected light having passed through smoke.

9. The system of claim 8, wherein the processor is configured to determine whether a change of intensity, or rate of change of intensity, of the received light falls within a second predetermined range that is indicative of the detected light having potentially passed through smoke, and if the received light falls within the second predetermined range, to slow or pause the movement of the moveable portion when the transmitter is aligned with a receiver.

10. The system of claim 1, comprising an alarm, wherein the system is configured to trigger or not trigger the alarm based on the light detected at the at least one receiver.

11. The system of claim 1, wherein the beam detector unit is configured to tilt the axis of rotation of the moveable portion as the movable portion rotates in order to align the at least one transmitter with the at least one of the plurality of reflectors.

12. A smoke detector system comprising:

a beam detector unit having a moveable portion comprising at least one light transmitter, a base portion for fixing to a surface, and a motor configured to rotate the moveable portion relative to the base portion;

at least one receiver for detecting light transmitted by the transmitter; and a processor and electronic circuitry configured such that, in an auto-calibration mode, the system: records both the rotational position of the movable member and the intensity of light detected by the at least one receiver; determines the rotational positions of the moveable member at which the intensity of light peaks; and designates these rotational positions as being the positions at which the at least one transmitter is aligned with the at least one receiver.

13. The system of claim 12, configured to control the motor, in a smoke detection mode, to rotate the movable portion such that it slows down or pauses at said rotational positions when the at least one transmitter is aligned with the at least one receiver.

* * * * *